US005893673A

United States Patent [19]

Edwards

[11] Patent Number: 5,893,673

[45] Date of Patent: Apr. 13, 1999

[54] PORTABLE, HAND HELD CONDIMENT DISPENSER

[76] Inventor: Tammy Jean Edwards, 232 Lakewood Dr., Pickens, S.C. 29671

[21] Appl. No.: 08/767,208

[22] Filed: Dec. 16, 1996

[51] Int. Cl.[6] ..... A46B 11/02

[52] U.S. Cl. ..... 401/186; 401/219; 401/280

[58] Field of Search ..... 401/186, 280

[56] References Cited

U.S. PATENT DOCUMENTS

| | | | |
|---|---|---|---|
| 1,028,011 | 5/1912 | Ferenczy | 401/280 X |
| 1,183,680 | 5/1916 | Sauer, Jr. | 401/280 X |
| 1,192,711 | 7/1916 | Turner | 401/280 X |
| 1,355,026 | 10/1920 | Austin | 401/280 X |
| 2,106,377 | 1/1938 | Lomas | 401/186 X |
| 5,186,559 | 2/1993 | Fu | 401/186 X |

*Primary Examiner*—Steven A. Bratlie

[57] ABSTRACT

A portable, hand held condiment dispenser for dispensing condiments onto items of food includes a container for holding a condiment, a valve controlling the flow of condiment from the container, and a releasably attached dispensing head, permitting use of different types of dispensing heads. The container includes a removable filling cap permitting the container to be refilled with a condiment. Alternatively, the container can be a pliant tube which can be squeezed in order to discharge the condiment from the container.

1 Claim, 3 Drawing Sheets

FIG. 3
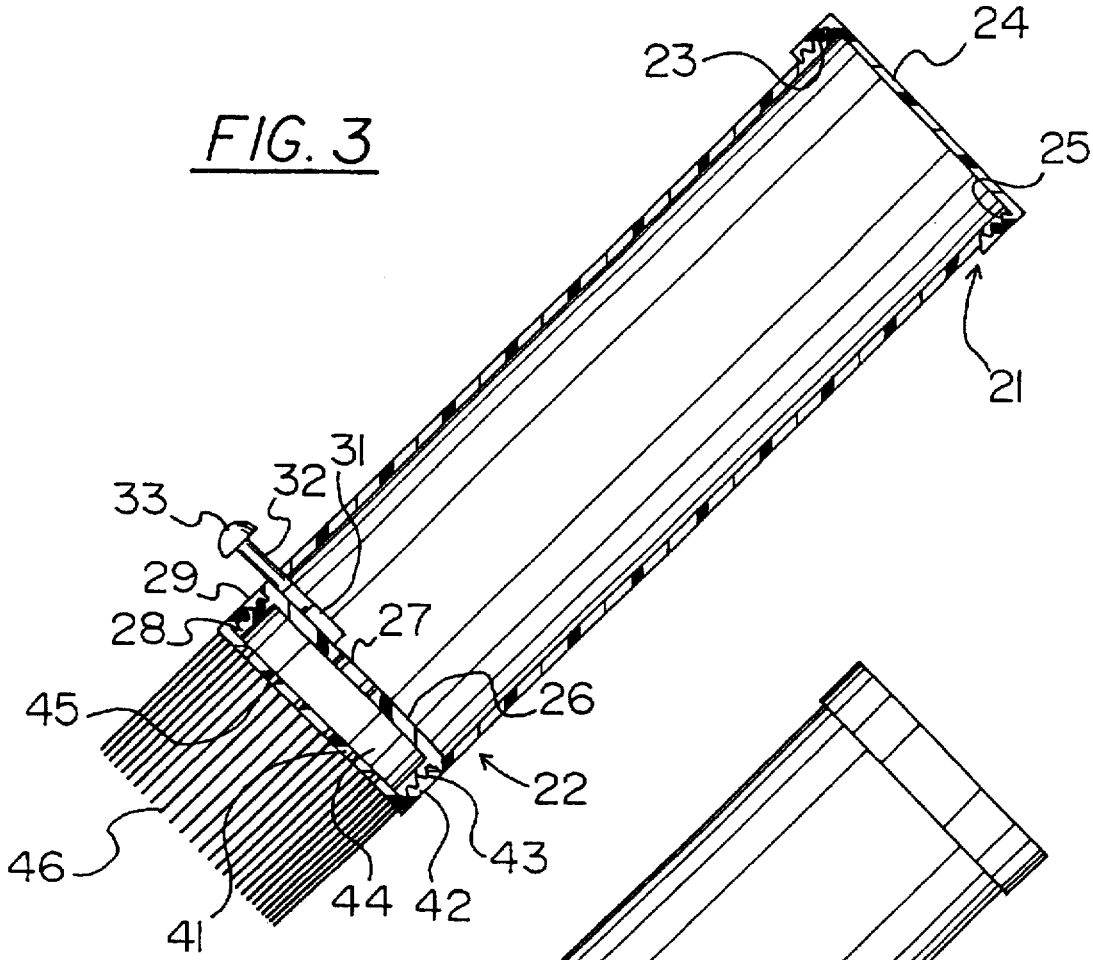
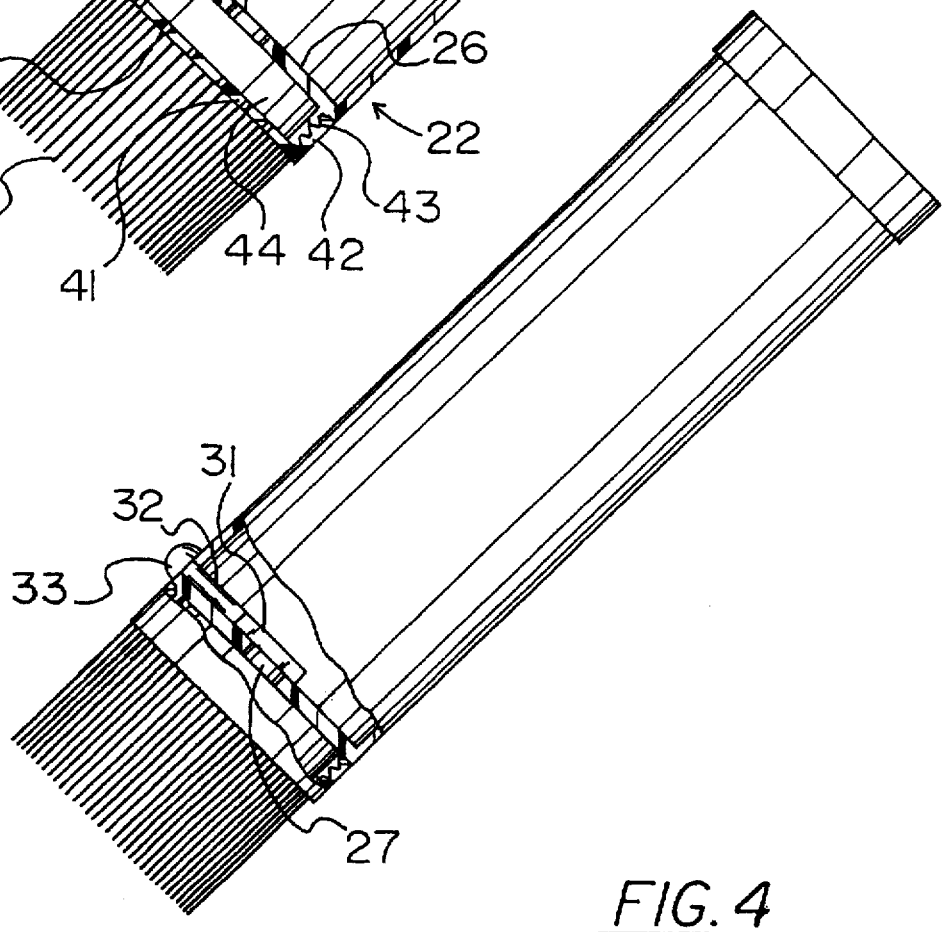
FIG. 4

PORTABLE, HAND HELD CONDIMENT DISPENSER

BACKGROUND OF THE INVENTION

1. Field of the Invention

The present invention relates to food applicators and more particularly pertains to a new portable, hand held condiment dispenser for dispensing a condiment onto an item of food.

2. Description of the Prior Art

The use of food applicators is known in the prior art. More specifically, food applicators heretofore devised and utilized are known to consist basically of familiar, expected and obvious structural configurations, notwithstanding the myriad of designs encompassed by the crowded prior art which have been developed for the fulfillment of countless objectives and requirements.

Known prior art food applicators include U.S. Pat. No. 5,328,509. Additionally, U.S. Pat. No. 5,213,431; U.S. Pat. No. 5,051017; U.S. Pat. No. Des. 346,112; U.S. Pat. No. 4,021,125 and U.S. Pat. No. 4,030,844 teach roll-on dispensers for dispensing personal care products, such as deodorant. However, these references only dispense personal care products, and therefore do not include releasable dispensing heads or refillable containers.

While these devices fulfill their respective, particular objectives and requirements, the aforementioned patents do not disclose a condiment dispenser. The inventive device includes a container holding a condiment, a valve controlling the flow of condiment from the container, and a releasably attached dispensing head, permitting use of different types of dispensing heads. The container includes a removable filling cap permitting the container to be refilled with a condiment. Alternatively, the container can be a pliant tube which can be squeezed in order to discharge the condiment from the container.

In these respects, the condiment dispenser according to the present invention substantially departs from the conventional concepts and designs of the prior art, and in so doing provides an apparatus primarily developed for the purpose of dispensing condiments onto items of food.

SUMMARY OF THE INVENTION

In view of the foregoing disadvantages inherent in the known types of food applicators now present in the prior art, the present invention provides a condiment dispenser construction wherein the same can be utilized for dispensing condiments onto items of food.

The general purpose of the present invention, which will be described subsequently in greater detail, is to provide a new condiment dispenser apparatus and method which has many of the advantages of the food applicators mentioned heretofore and many novel features that result in a new condiment dispenser which is not anticipated, rendered obvious, suggested, or even implied by any of the prior art food applicators, either alone or in any combination thereof.

To attain this, the present invention generally comprises a container holding a condiment, a valve controlling the flow of condiment from the container, and a releasably attached dispensing head, permitting use of different types of dispensing heads. The container includes a removable filling cap permitting the container to be refilled with a condiment. Alternatively, the container can be a pliant tube which can be squeezed in order to discharge the condiment from the container.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a condiment dispenser apparatus and method which has many of the advantages of the food applicators mentioned heretofore and many novel features that result in a condiment dispenser which is not anticipated, rendered obvious, suggested, or even implied by any of the prior art food applicators, either alone or in any combination thereof.

It is another object of the present invention to provide a condiment dispenser which may be easily and efficiently manufactured and marketed.

It is a further object of the present invention to provide a condiment dispenser which is of a durable and reliable construction.

An even further object of the present invention is to provide a condiment dispenser which is susceptible of a low cost of manufacture with regard to both materials and labor, and which accordingly is then susceptible of low prices of sale to the consuming public, thereby making such condiment dispenser economically available to the buying public.

Still yet another object of the present invention is to provide a condiment dispenser which provides in the apparatuses and methods of the prior art some of the advantages thereof, while simultaneously overcoming some of the disadvantages normally associated therewith.

Still another object of the present invention is to provide a condiment dispenser for dispensing condiments onto items of food.

Yet another object of the present invention is to provide a condiment dispenser which includes a container holding a condiment, a valve controlling the flow of condiment from the container, and a releasably attached dispensing head, permitting use of different types of dispensing heads. The container includes a removable filling cap permitting the container to be refilled with a condiment. Alternatively, the container can be a pliant tube which can be squeezed in order to discharge the condiment from the container.

Still yet another object of the present invention is to provide a condiment dispenser that comes in kit form for use on a wide range of food applications.

Even still another object of the present invention is to provide a condiment dispenser that is easy to use and reduces mess.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken along line 3—3 of FIG. 2.

FIG. 4 is a partial cross sectional view of the dispenser showing the valve in a closed position.

DESCRIPTION OF THE PREFERRED EMBODIMENT

Figure 1:
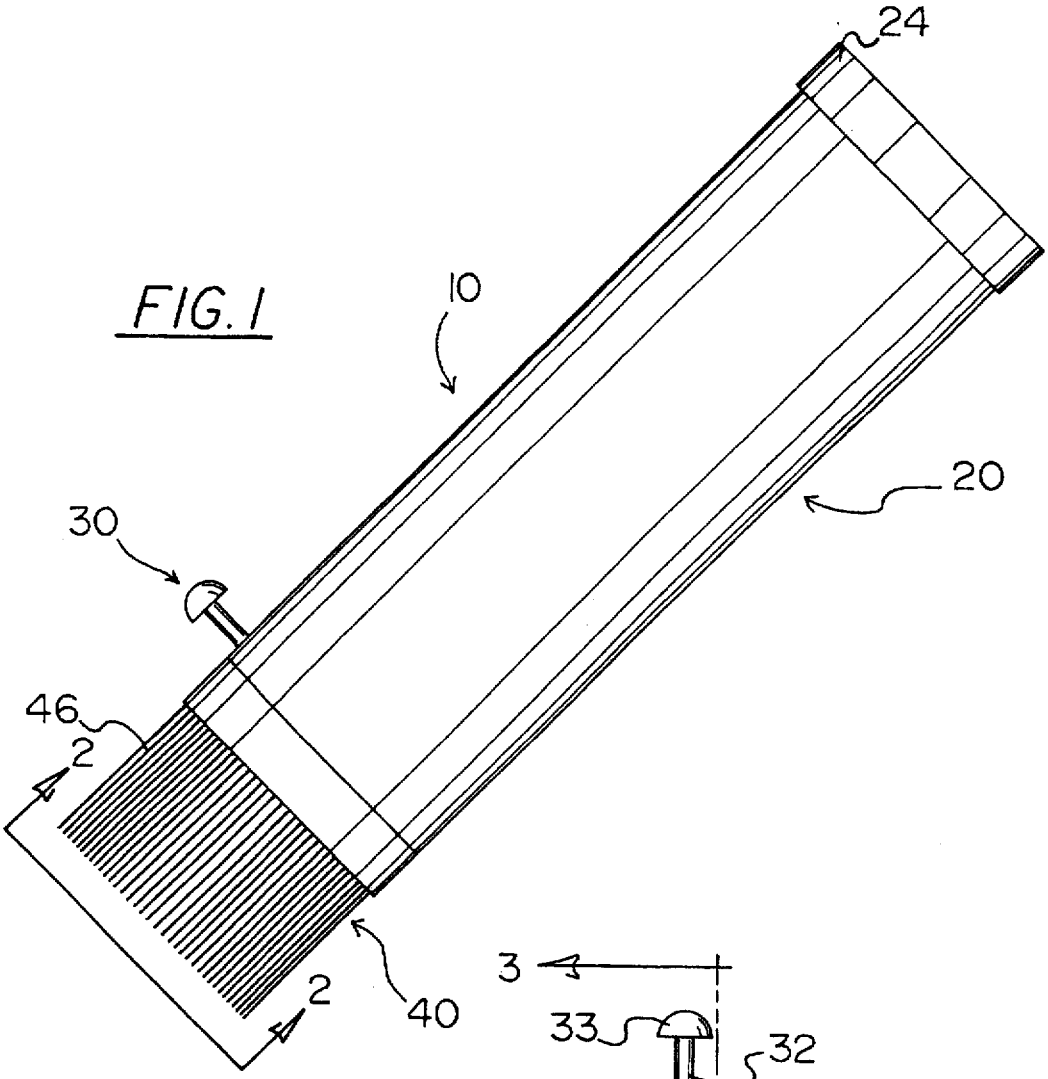
FIG. 1 is a perspective view of a condiment dispenser according to the present invention.
Figure 2:
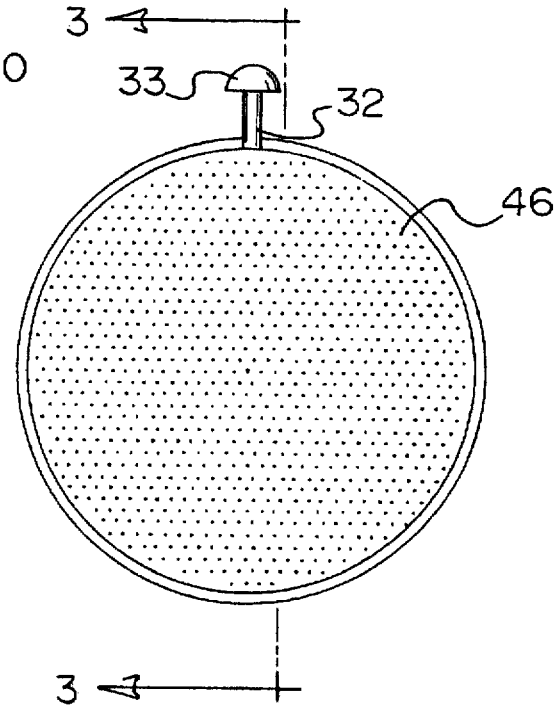
FIG. 2 is a view taken along line 2—2 of FIG. 1.

With reference now to the drawings, and in particular to FIGS. 1 through 6 thereof, a condiment dispenser embodying the principles and concepts of the present invention and generally designated by the reference numeral 10 will be described.

More specifically, it will be noted that the condiment dispenser 10 comprises a container 20 with a valve mechanism 30 and a dispensing head 40 releasably connected to the container. The term condiment, as used throughout, is meant to include, but is not limited to, ketchup, mustard, mayonnaise, jams, jellies, and the like.

As best illustrated in FIGS. 1 through 6, it can be shown that the container 20 is a generally cylindrical, hollow rigid tube having a first, filling end 21, and a second, dispensing end 22. The end 21 includes an exterior thread 23 which mates with an interior thread 25 of a filling cap 24, in order to releasably secure the filling cap 24 to the container. The container contains a condiment, which can be refilled by removing the cap 24 as the need arises. The main portion of the container 20 forms a gripping portion which permits a user to grasp and hold the container in his hand.

Alternatively, the container 20 could be made of a pliant, closed tube (similar to a tube of toothpaste) which can be squeezed in order to dispense the condiment from the container. The pliant container would be prefilled with a condiment and would be disposed of when the condiment is used up.

The dispensing end 22 of the container includes an end wall 26 with an outlet aperture 27. The aperture 27 permits the condiment to flow from the container. A flange 28 having an exterior thread 29 extends from the wall 26, for mating engagement with the dispensing head 40.

In order to control flow through the aperture 27, a valve 30 is provided. The valve 30 includes a valve plate 31 which selectively covers/uncovers the aperture, a stem 32 connected to the plate and extending through the container wall, and a control knob 33 connected to the stem. By grasping the knob 33 and pushing in, or pulling out, the stem 32, the plate 31 is moved to cover/uncover the aperture and thus control the flow of condiment.

The dispensing head 40 includes a base plate 41 with a flange 42 extending therefrom. The flange 42 includes an interior thread 43 which mates with the exterior thread 29 for releasably attaching the head 40 to the container. A space 44 is thus defined between the base plate 41 and the end wall 26. A plurality of apertures 45 are formed through the base plate 41, permitting the flow of the condiment from the aperture 27 and the space 44. Compliant bristles 46 are attached to the base plate 41 and extend therefrom. The dispensing head 40 thus resembles a brush head, where the condiment is disposed on the food item by brushing the bristles across the food item.

With the container held in the position shown in FIG. 1, gravity causes the condiment in the container to flow through the aperture 27 with the valve opened. The condiment then goes into the space 44 and out through the apertures 45. The condiment then flows onto the bristles 46 for disposition onto the food item.

Figure 5:
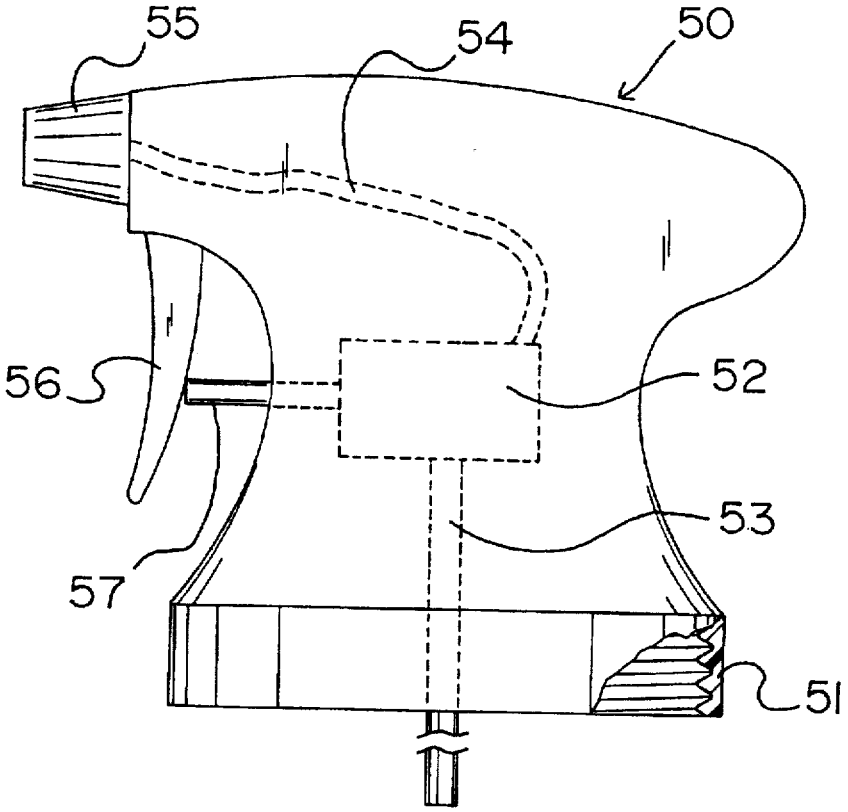
FIG. 5 is a view of an alternate embodiment of a dispensing head.

Instead of the brush head 40, different dispensing heads can be used instead. For instance, FIG. 5 shows a spray head 50 which is attached to the container 20 using a threaded flange 51. A pump mechanism 52 is disposed inside of the spray head for pumping the condiment from the container. A suction tube 53 is in communication with the inlet of the pump 52 and has a sufficient length such that it would extend through the aperture 27 and into the inside of the container 20. Outlet tube 54 leads from the pump outlet to a spray nozzle 55. The pump is actuated by a trigger 56 which is pulled and released to cause reciprocation of an actuation shaft 57 in a manner well known in the art. The condiment is thus sprayed out the nozzle 55 by pulling the trigger 56.

Figure 6:
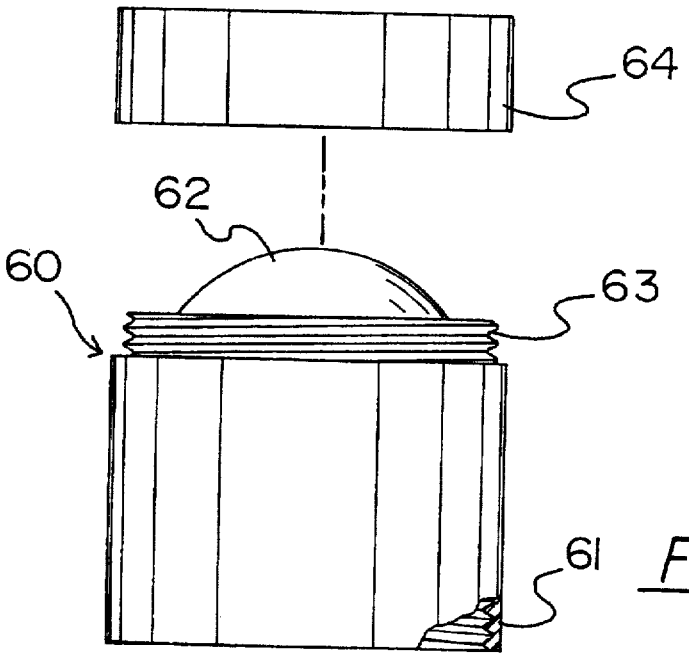
FIG. 6 is a view showing another embodiment of a dispensing head.

FIG. 6 shows another embodiment of a dispensing head 60. Again, the head 60 is attached to the container by a threaded flange 61. The head 60 includes a roller ball 62 which is rotationally supported within the head in a manner well known in the art. The ball 62 is in communication with the condiment, such that when the ball is rolled on a food item, the condiment is spread onto the item of food. The head 60 can also include an exterior thread 63 for mating with threads on a cap 64.

Thus it should be realized that the dispensing heads 40,50,60 are all interchangeably used on the container for providing different means for dispensing a condiment onto a food item. It should also be recognized that condiment container(s) and the different dispensing heads could be sold together in a kit form. Therefore the user has a choice of dispensing heads and condiment containers to use. The container(s) could either come prepackaged with a condiment or the user would fill with his favorite condiment, and the container(s) could either be refillable or disposable.

In use, a particular dispensing head is chosen and attached to the container. The brush head and roll-on head utilize gravity to cause the condiment to flow from the container, or if the container is squeezable, the squeezing action causes the flow. The spray head uses a pump to pump the condiment onto the food item, whether the container is rigid or pliant.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A condiment dispenser comprising:

a generally cylindrical container for holding a condiment to be dispensed, the container including a gripping portion for permitting the container to be hand held, the container further including a dispensing end having a centrally positioned aperture through which the condiment is permitted to flow from the container;

a valve means for controlling the condiment flow through the aperture, the valve means having a valve plate extending from a valve stem, said valve means further having a control knob coupled to a distal end of the valve stem opposite the valve plate, the valve means being attached to the container such that the valve plate is slidable to cover the aperture, said control knob extending through said container and being positioned adjacent an outer surface of the container when said valve plate covers said aperture whereby the valve plate selectively prevents the condiment from flowing from the container, said control knob further being extendable away from said outer surface of said container such that said aperture is opened to permit flow of said condiment through said aperture;

the dispensing end having a generally annular extension disposed therefrom with a reduced diameter with respect to that of the container, the annular extension being threaded on an outer surface of the annular extension;

a generally round dispensing head, said dispensing head having an outer perimeter wall coupled to a periphery of the dispensing head and extending therefrom, said outer perimeter wall having interior threading for engaging said annular extension of the container, whereby the dispensing head is releasably attached to the dispensing end of the container in spaced relation to the aperture, the dispensing head being permeable to allow flow of the condiment through the dispensing head for dispensing the condiment onto an item of food;

wherein the dispensing head comprises a brush head having a plurality of bristles in communication with the condiment flow through the aperture;

wherein the container includes a removable filling cap on a container end opposite the dispensing end, the filling cap being removable to permit the container to be filled with the condiment, wherein the container has exterior threads and the removable filling cap has a flange with interior threads; and wherein the container includes a pliant outer wall that is squeezable such that the condiment is urged through the aperture when the container is squeezed;

wherein the control knob of the valve means extends through the outer wall of the container such that the valve plate is selectively positionable proximate the aperture by manipulation of the control knob;

wherein upon attachment of the dispensing head to the container, a space is defined between the valve plate and the dispensing head that has a depth equal to that of the annular extension.

* * * * *